US006109623A

United States Patent [19]

Roman et al.

[11] Patent Number: 6,109,623

[45] Date of Patent: Aug. 29, 2000

[54] WHEEL SUPPORTING FRAME FOR SKATES

[75] Inventors: Maurizio Roman, Noale; Nicola Belli, Marghera; Daniele Fuser, Sala D'Istrana, all of Italy

[73] Assignee: Benetton Sportsystem S.p.A., Trevignano, Italy

[21] Appl. No.: 09/084,376

[22] Filed: May 27, 1998

[30] Foreign Application Priority Data

Jun. 9, 1997 [IT] Italy ..... TV97A0075

[51] Int. Cl.[7] ..... A63C 17/06

[52] U.S. Cl. ..... 280/11.22; 280/11.28

[58] Field of Search ..... 280/11.22, 11.27, 280/11.28, 11.19, 11.23

[56] References Cited

U.S. PATENT DOCUMENTS

| | | | |
|---|---|---|---|
| 3,086,787 | 4/1963 | Wyche | 280/11.27 |
| 5,342,071 | 8/1994 | Soo | 280/11.22 |
| 5,366,232 | 11/1994 | Pozzobon et al. | 280/11.22 |
| 5,720,488 | 2/1998 | Foffano et al. | 280/11.22 |
| 5,799,955 | 9/1998 | Iverson | 280/11.22 |
| 5,803,466 | 9/1998 | Wrike | 280/11.27 X |
| 5,934,693 | 8/1999 | Nicoletti | 280/11.22 |

FOREIGN PATENT DOCUMENTS

| | | |
|---|---|---|
| 0686413 | 12/1995 | European Pat. Off. . |
| 296 11 033 U | 9/1996 | Germany . |

*Primary Examiner*—Michael Mar

*Attorney, Agent, or Firm*—Guido Modiano; Albert Josif; Daniel O'Byrne

[57] ABSTRACT

A frame particularly for skates, including at least one pair of lateral wings between which pivots are transversely associated, wheels being rotatably associated with the pivots. In the frame, the base and/or the pair of lateral shoulders are constituted by a plurality of first substantially rigid elements which are interconnected, in preset regions, by second elements adapted to cushion stresses and/or vibrations transmitted by the wheels.

14 Claims, 19 Drawing Sheets

WHEEL SUPPORTING FRAME FOR SKATES

BACKGROUND OF THE INVENTION

The present invention relates to a wheel supporting frame for skates, particularly for in-line roller skates.

A problem currently felt in the manufacture of skates is that the wheels transmit directly to the frame, and the frame transmits directly to the shoe, all the stresses and/or vibrations due to uneven ground.

As a partial solution to this drawback, Italian Patent application TV91A000129 has been filed Dec. 20, 1991, disclosing a skate with in-line wheels, which comprises a wheel supporting frame between two shoulders and interacting with means for adjusting its position with respect to the support, with flexible and/or vibration-damping elements interposed.

A frame is thus described which is composed of a shoe support from which two shoulders protrude; a first seat is formed between said shoulders and accommodates a frame movable at right angles to the ground within said first seat in contrast with flexible and/or vibration-damping elements; a means for adjusting the position of the frame with respect to the support is also provided, constituted by a suitably arranged screw.

This skate has the drawback of being complicated from the constructive point of view, because the presence of several elements, which slide with respect to each other, requires the guides to be precise and non-deformable over time, this last feature being necessary owing to the various uses of the skate.

Accordingly, precise machining is required and expensive materials must be used.

The skate has also a considerable overall weight, owing to the presence of the frame which can slide with respect to the support, of the adjustment means and of the flexible and/or vibration-damping elements.

Said elements are also exclusively subjected to compressive stress and therefore they are unable for example to cushion multidirectional stresses, which can occur for example during skate thrusting or during curves or jumps or other maneuvers.

Moreover, the cross-section of the flexible and/or vibration-damping elements, adapted to cushion the stresses, is the smallest, since it corresponds to the thickness of said elements. Accordingly, it is necessary to provide thicknesses which are adequate to ensure effective cushioning and this entails considerable bulk and therefore difficulties in accommodation inside the frame.

This structural complexity can also be subject to changes and therefore to less-than-optimum operation following a plurality of impacts affecting the skate during use.

Furthermore, Italian Utility Model application TV92U000038 has been filed Jul. 9, 1992, disclosing a shock-absorber for in-line skates which comprise a frame provided with two shoulders between which said wheels are arranged, characterized in that at said pair of shoulders, along an axis which is approximately perpendicular to the ground, at least one pair of slots is provided with which at least one flexible element is associable, said flexible element having at least one engagement seat for a pivot for the rotation of said wheels.

In this shock-absorber, the flexible elements cushion only part of the stresses from the ground owing to their specific technical characteristics; substantially, it has been observed that the elastic elements are capable of cushioning only the forces that have a vertical direction with respect to the ground but are unable to cushion for example the horizontal components of frontal impacts of the wheels and do not allow, like the previous solution, to cushion multidirectional stresses.

In this case too, the need to provide the seats for the flexible elements weakens, as in the previous case, the overall structure of the frame, and the seats also require additional processing steps.

These additional steps, together with the particular dimensions, shape and quality of the flexible elements, which must ensure good operation over time and must not deteriorate due to variable weather conditions, increase the overall costs of the skate.

SUMMARY OF THE INVENTION

An aim of the present invention is to solve the above-mentioned problems, eliminating the drawbacks of the cited prior art, by providing a skate which allows to cushion stresses, impacts and vibrations caused by uneven regions of the ground and transmitted to the frame by the wheels, said frame maintaining a single and continuous structure which is not interrupted or modified by seats or fixing points for external shock-absorbing and/or adjustment elements, so as to have improved stability characteristics.

An important object of the present invention is to provide a skate in which the frame allows to cushion the stresses also if they are not essentially due to a component which is vertical to the ground but are also multidirectional and as such occur along the three Cartesian axes.

A further important object of the present invention is to provide a skate in which the stresses applied by each individual wheel can be cushioned locally so that the behavior of each individual wheel can be considered to be approximately independent of the behavior of the other wheels.

A further important object of the present invention is to provide a skate in which the frame is constituted by a limited number of components which increase its durability.

A further object of the present invention is to provide a skate which comprises a frame having a modest overall weight and can be manufactured at low cost.

This aim, these objects and others which will become apparent hereinafter are achieved by a wheel supporting frame for skates, comprising a base and lateral shoulders, a plurality of wheels being rotatably associated with said shoulders, characterized in that said at least one base and/or lateral shoulders are constituted by a plurality of first substantially rigid elements which are interconnected, in at least one preset region, by second elements whose characteristics are suitable to cushion stresses and/or vibrations transmitted by said wheels.

BRIEF DESCRIPTION OF THE DRAWINGS

Further characteristics and advantages of the frame according to the present invention will become apparent from the following detailed description of some particular but not exclusive embodiments thereof, illustrated only by way of non-limitative example in the accompanying drawings, wherein.

DESCRIPTION OF THE PREFERRED EMBODIMENTS

Figure 1:
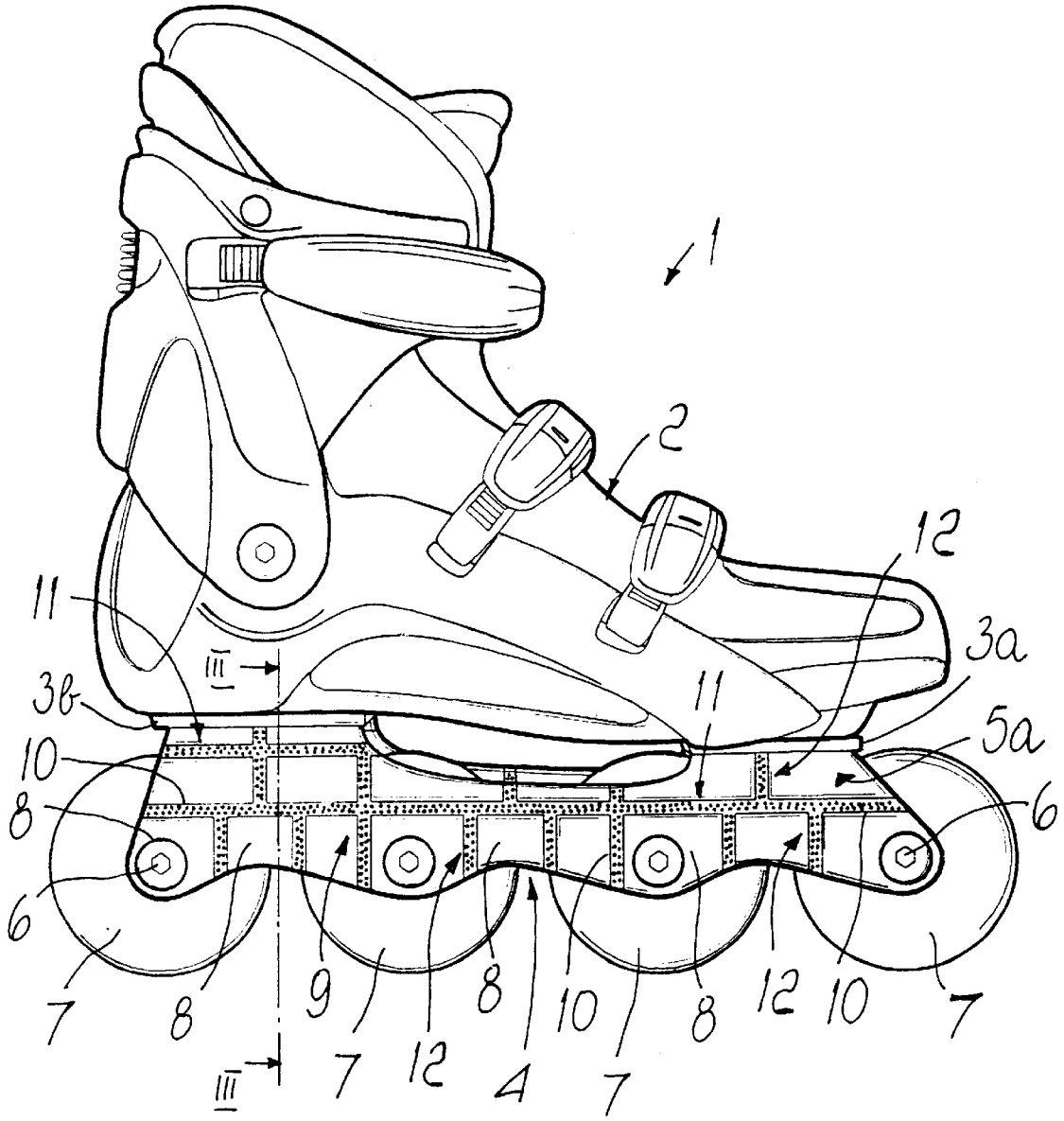
FIG. 1 is a side view of a first embodiment.

With reference to the above figures, the reference numeral 1 designates a skate constituted by a shoe 2 which is associated at a pair of bases 3*a* and 3*b* which constitute a frame, generally designated by the reference numeral 4.

Lateral shoulders, designated by the reference numerals 5*a* and 5*b*, protrude from bases 3*a* and 3*b*; the shoulders are mutually parallel, and pivots 6 are transversely associated between them. Wheels 7 are rotatably associated with the pivots and are thus arranged in-line.

The frame comprises first substantially rigid elements 8 which are conveniently contoured and sized and interconnected, in regions 9, by second elements 10 whose characteristics are suitable to cushion stresses and/or vibrations and/or impacts transmitted to the wheels by uneven ground.

Advantageously, the regions 9 can be formed by a latticed structure and thus be constituted for example by a plurality of longitudinal portions 11 and of portions 12 which are perpendicular thereto and are staggered as shown in FIG. 1.

The connection between the first and second elements is of the fixed and stable type, so as to form a monolithic body for the frame 4.

The technology used is a known technology, suitable to provide stable couplings between two or more elements, such as gluing, overmolding, welding, etcetera.

The second elements can also have characteristics, such as high elasticity and/or low rigidity and/or low brittleness and/or high impact-absorbing ability and/or high fatigue strength and others which are in any case suitable to cushion stresses, impacts and vibrations applied to the wheels by uneven regions of the ground.

The second elements thus have both stress-absorbing characteristics and characteristics for connection to the first elements, allowing, because of their particular lattice or generally mosaic composition, to cushion stresses regardless of their direction of origin.

It has thus been observed that the invention has achieved the intended aim and objects, a frame having been provided which cooperates as a whole to the cushioning of stresses although being constituted by a single and continuous element without seats or fixing points for external shock-absorbing elements.

The frame, owing to the particular composition and arrangement of the first and second elements, also allows to cushion stresses regardless of their direction of origin, each wheel being also capable of cushioning the stresses applied thereto without said stresses being fully transmitted not only to the shoe but also to the remaining wheels associated with the lateral shoulders 5*a* and 5*b*.

Furthermore, the frame is constituted by a single element which as such has low production costs and weight.

The frame according to the invention is of course susceptible of numerous modifications and variations, all of which are within the scope of the same inventive concept.

Figure 4:
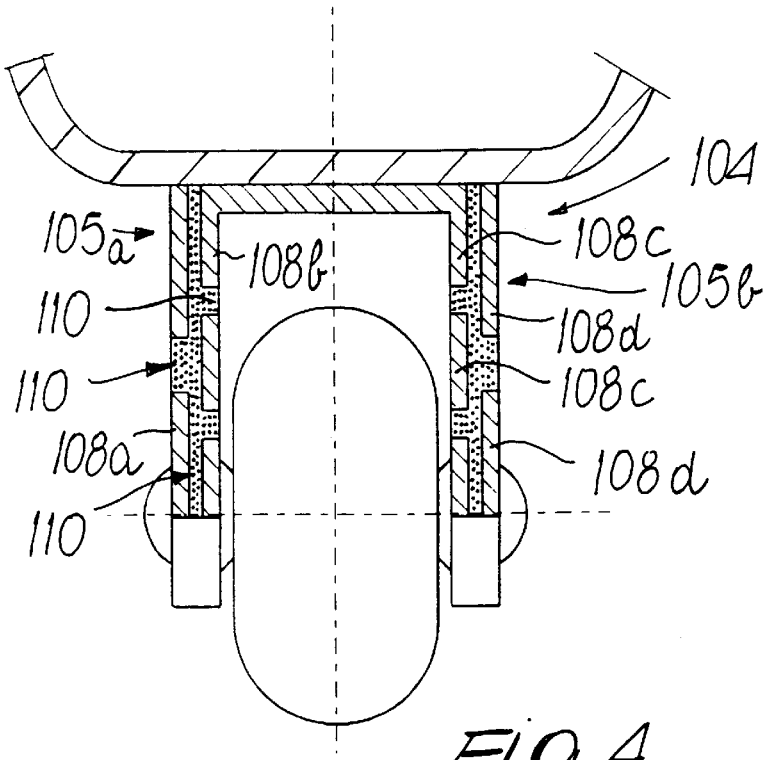
FIG. 4 is a view, similar to FIG. 3, of a third embodiment.

Thus, for example, FIG. 4 illustrates another embodiment, in which the second elements 110 are associated at the lateral shoulders 105*a* and 105*b* and are embedded between a double cladding constituted by first elements 108*a*, 108*b* and 108*c*, 108*d*.

This embodiment improves the rigidity and lateral flexural strength characteristics of the frame; this is particularly useful in view of the highly differentiated skating techniques currently developed.

Figure 2:
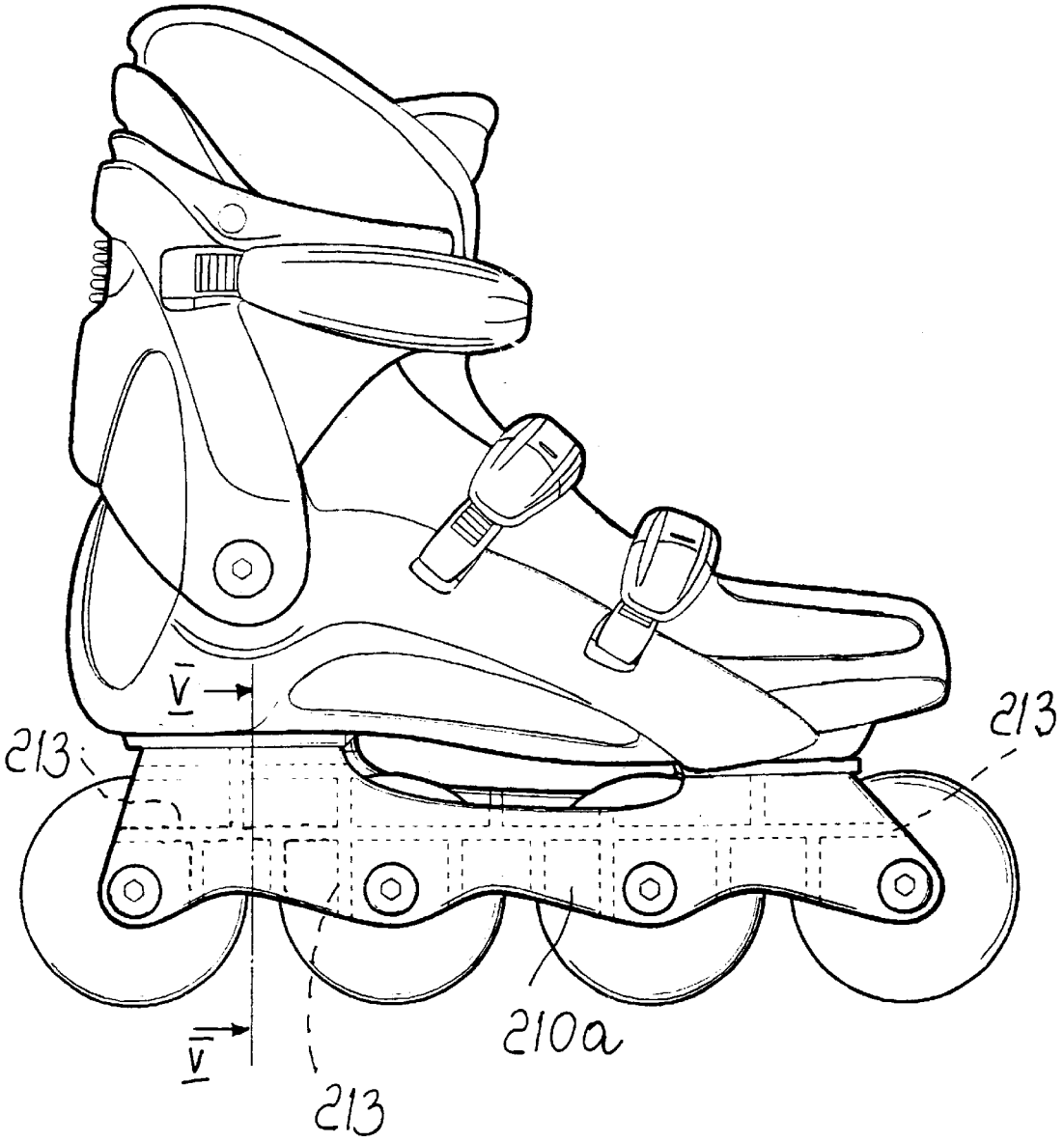
FIG. 2 is a view, similar to FIG. 1, of a second embodiment.
Figure 3:
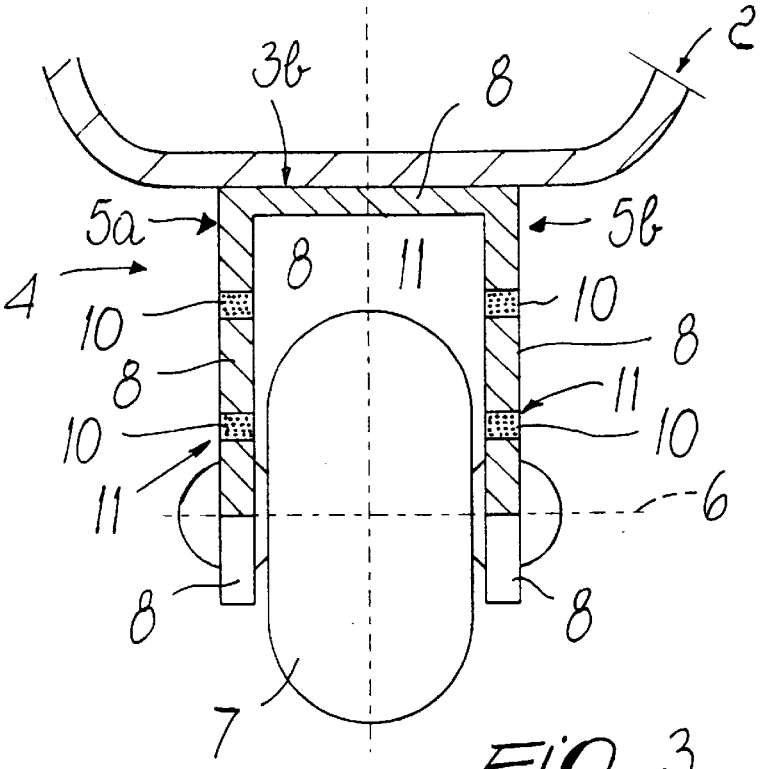
FIG. 3 is a sectional view, taken along the plane III—III of FIG. 1.
Figure 5:
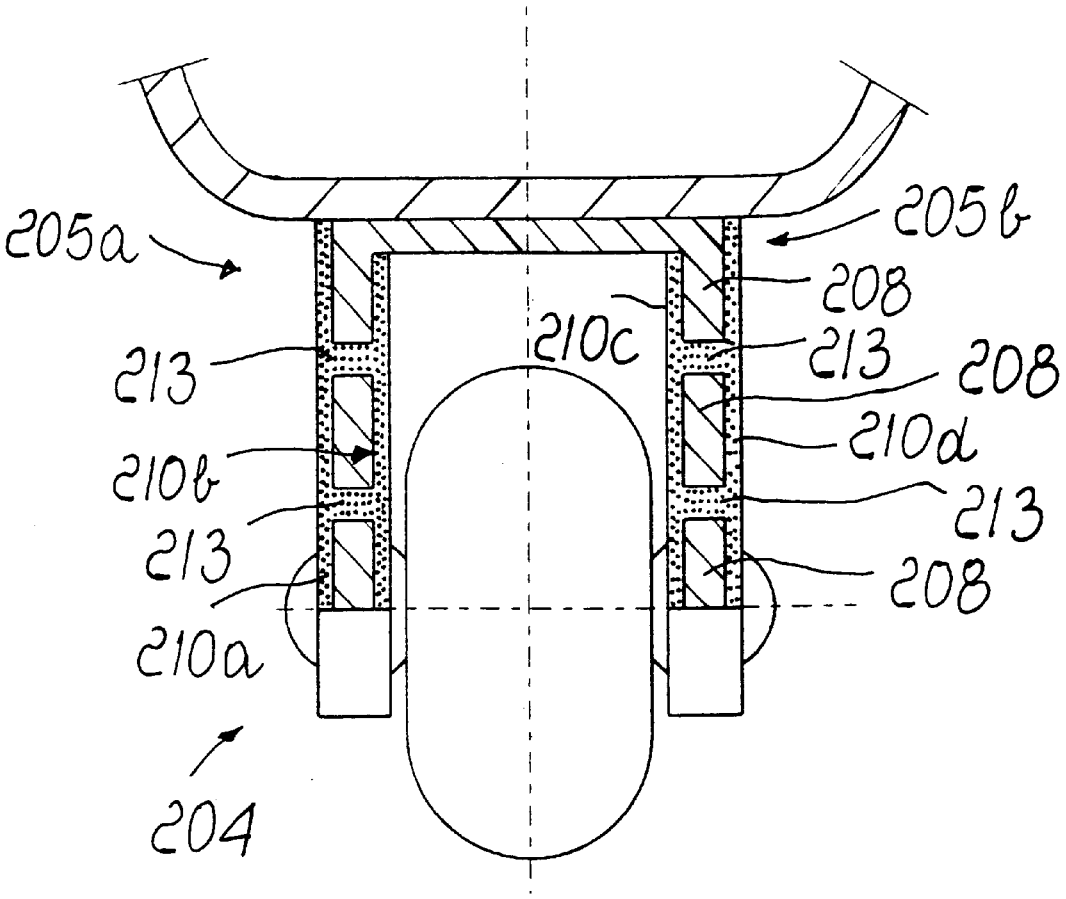
FIG. 5 is a sectional view, taken along the plane V—V of FIG. 2.

FIGS. 2 and 5 illustrate another embodiment, in which the first elements 208, formed at the lateral shoulders 205*a* and 205*b*, are embedded in a double cladding of second elements 210*a*, 210*b*, 210*c* and 210*d* which are mutually connected by a plurality of bridges 213.

This double cladding decreases the external wear of the frame 204 or, if a more rigid material is used, it improves the technical and structural characteristics of the invention.

Figure 6:
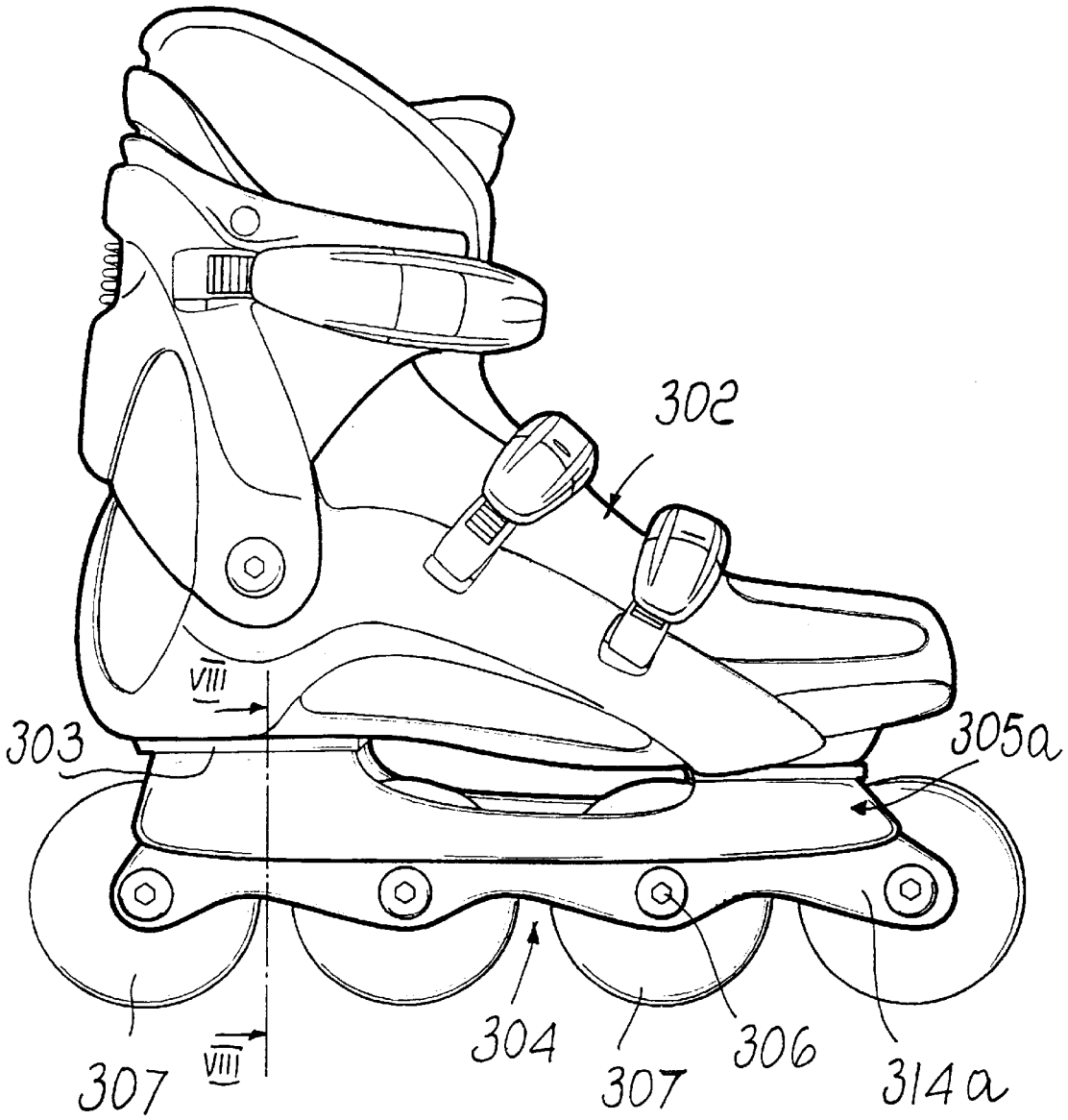
FIGS. 6 and 7 are views, similar to FIG. 1, of further embodiments.
Figure 8:
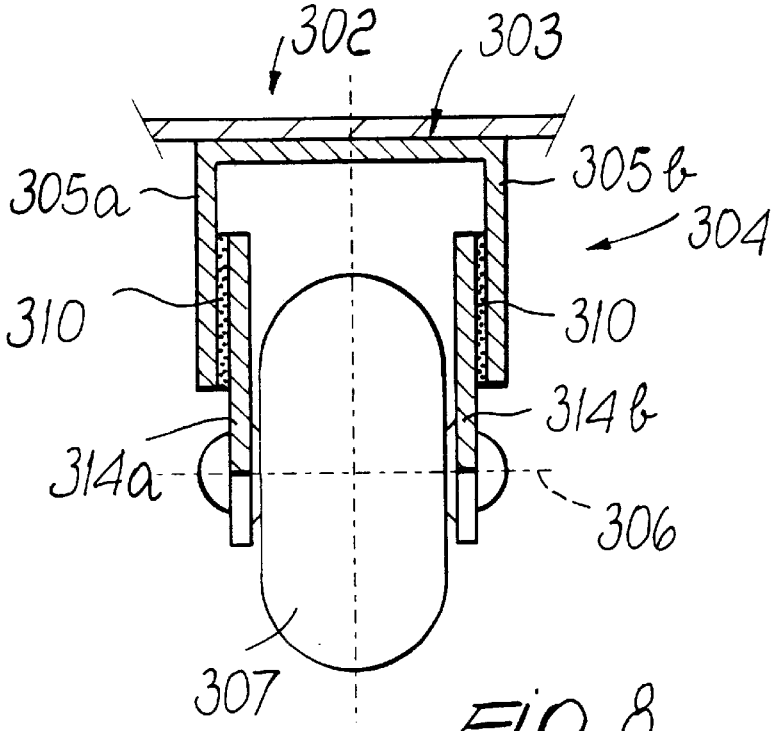
FIG. 8 is a sectional view, taken along the plane VIII—VIII of FIG. 6.

FIGS. 6 and 8 illustrate another embodiment of a frame 304, which is constituted by at least one base 303 for supporting a shoe 302, from which two lateral shoulders 305*a* and 305*b* protrude. A layer of second elements 310 for connection to a pair of wings 314*a*, 314*b* is associated at the facing surfaces of said shoulders, and said wings protrude beyond the end of the lateral shoulders; the wheels 307 are transversely pivoted, by means of suitable pivots 306, between said wings.

The wheels thus transmit the stresses caused by uneven regions of the ground to the wings 314*a* and 314*b*, which do not transfer said stresses to the lateral shoulders 305*a* and 305*b* by virtue of the interposition of the second elements 310, said wings and said pairs of lateral shoulders constituting said first elements.

Figure 7:
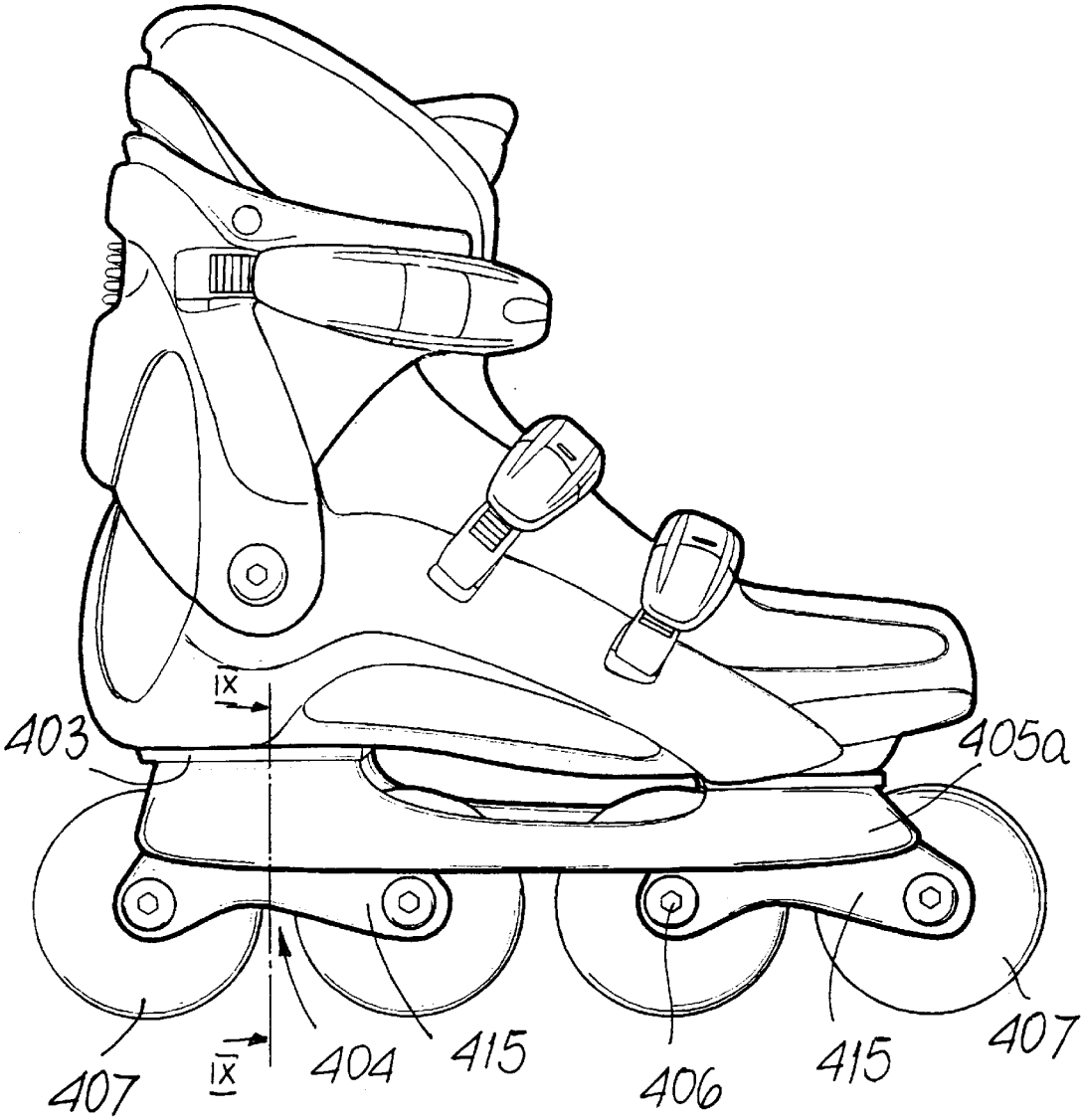
Figure 9:
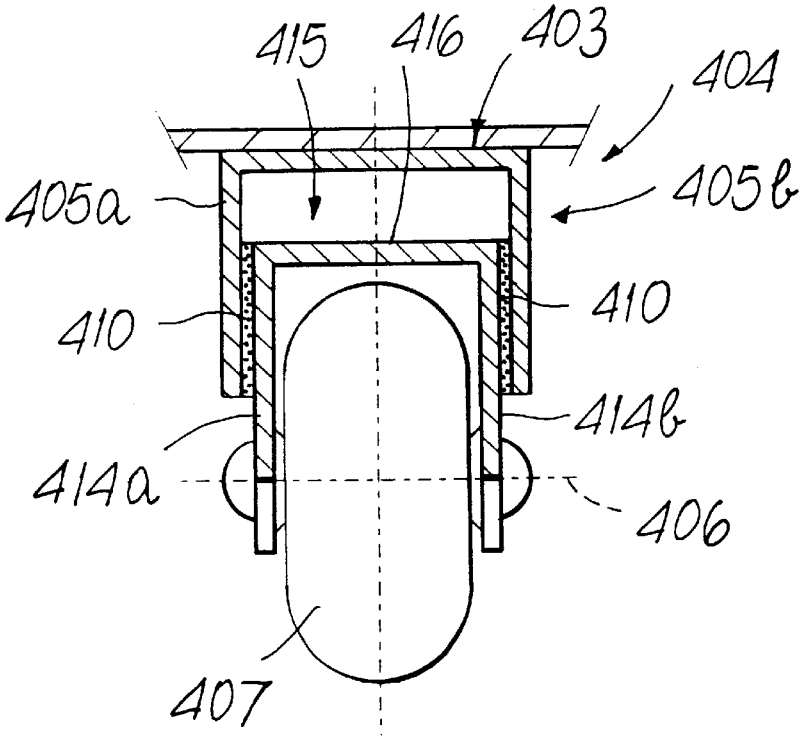
FIG. 9 is a sectional view, taken along the plane IX—IX of FIG. 7.

According to a further embodiment, shown in FIGS. 7 and 9, the wings 414*a* and 414*b* of a truck 415 are advantageously arranged, with a layer of second elements 410 interposed, at the facing lateral surfaces of the pair of lateral shoulders 405*a* and 405*b*; said truck 415 also has a horizontal portion 416 for connecting said wings which is arranged approximately parallel to the base 403 of the frame 404.

Wheels 407 are rotatably freely associated, by means of the pivots 406, proximate to the free ends of the wings 414*a* and 414*b*.

Advantageously, as shown in FIG. 7, it is possible to apply two separate trucks 415 between the shoulders 405*a* and 405*b*.

Figure 10:
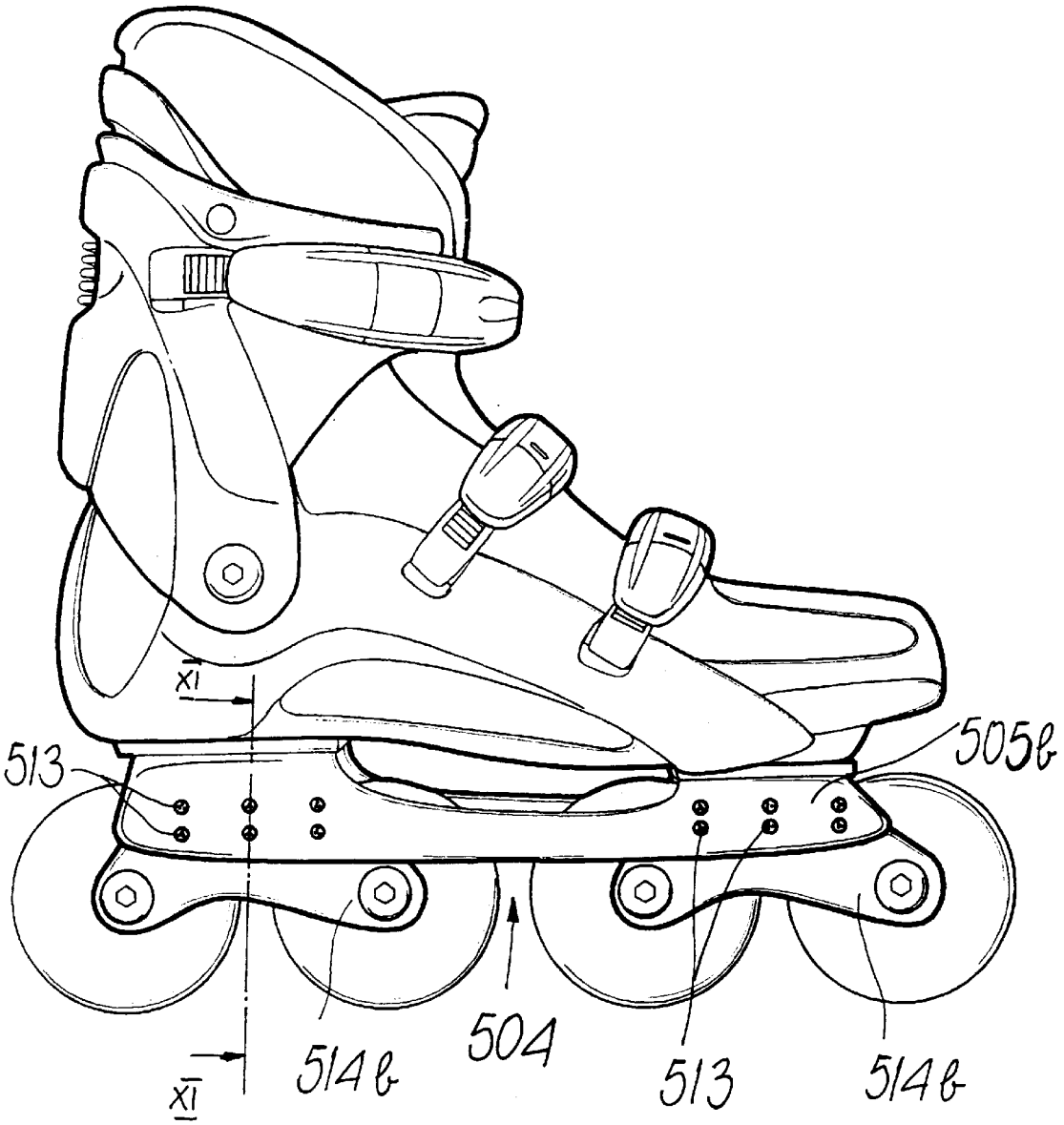
FIG. 10 is a view, similar to FIG. 1, of another embodiment.
Figure 11:
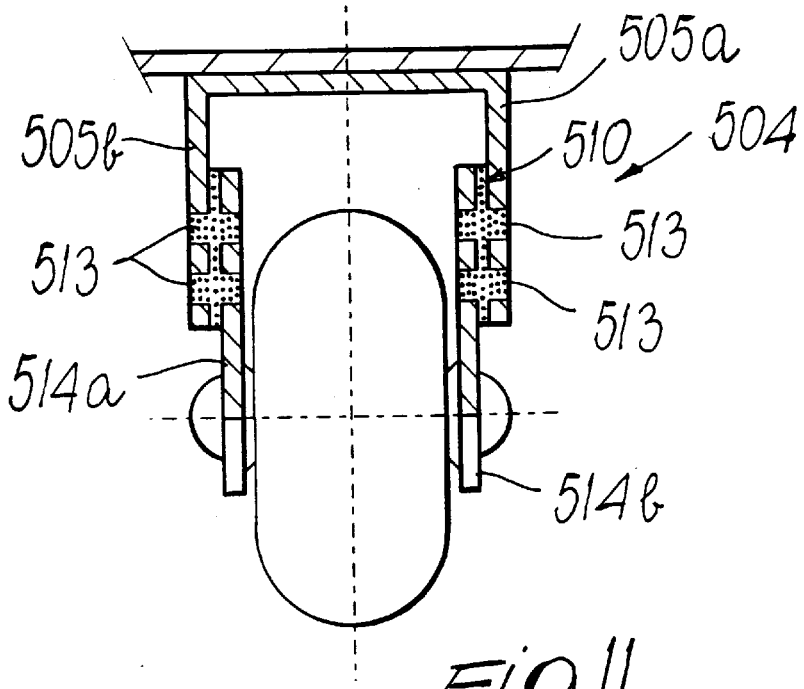
FIG. 11 is a sectional view, taken along the plane XI—XI of FIG. 10.

FIGS. 10 and 11 illustrate another embodiment of a frame 504 in which, differently from the embodiment shown in FIG. 8, the second elements 510 have bridges 513 which affect the thickness of the lateral shoulders 505*a* and 505*b* and of the wings 514*a* and 514*b*, through holes being formed therein.

Figure 12:
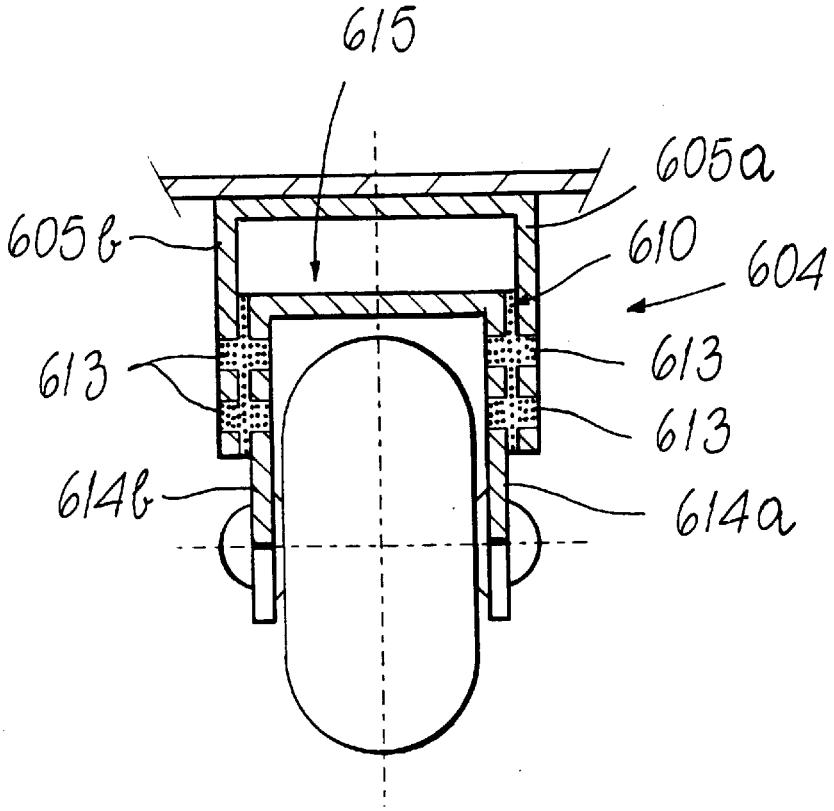
FIG. 12 is a view, similar to FIG. 11, of another embodiment.

FIG. 12 illustrates a different embodiment with respect to FIG. 9; namely, the second elements 610 have bridges 613 which connect, along their thickness, the wings 614*a* and 614*b* of a truck 615 and the lateral shoulders 605*a* and 605*b* of the frame 604.

These embodiments, shown in FIGS. 10, 11 and 12, also allow to increase the reliability of the coupling of the second elements to the frame and therefore the fatigue resistance thereof.

Figure 13:
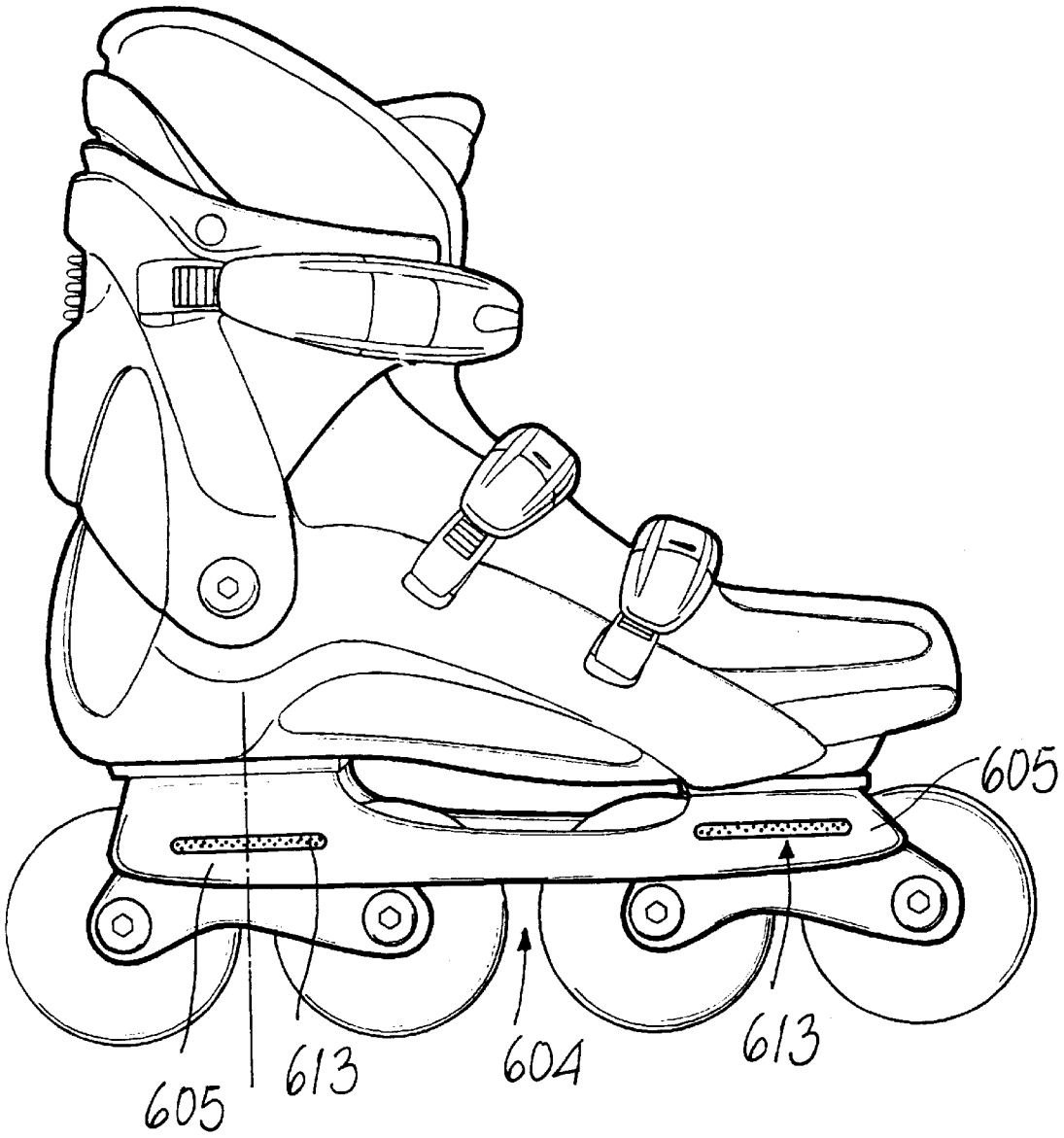
FIGS. 13 and 14 are views, similar to FIG. 1, of further embodiments.

FIG. 13 illustrates another embodiment in which, with respect to the previous embodiments, the second elements have bridges 613 which do not affect holes but instead affect slots formed at the lateral shoulders 605 of the frame 604.

The surface for grip between the first and second elements is thus further increased.

Figure 14:
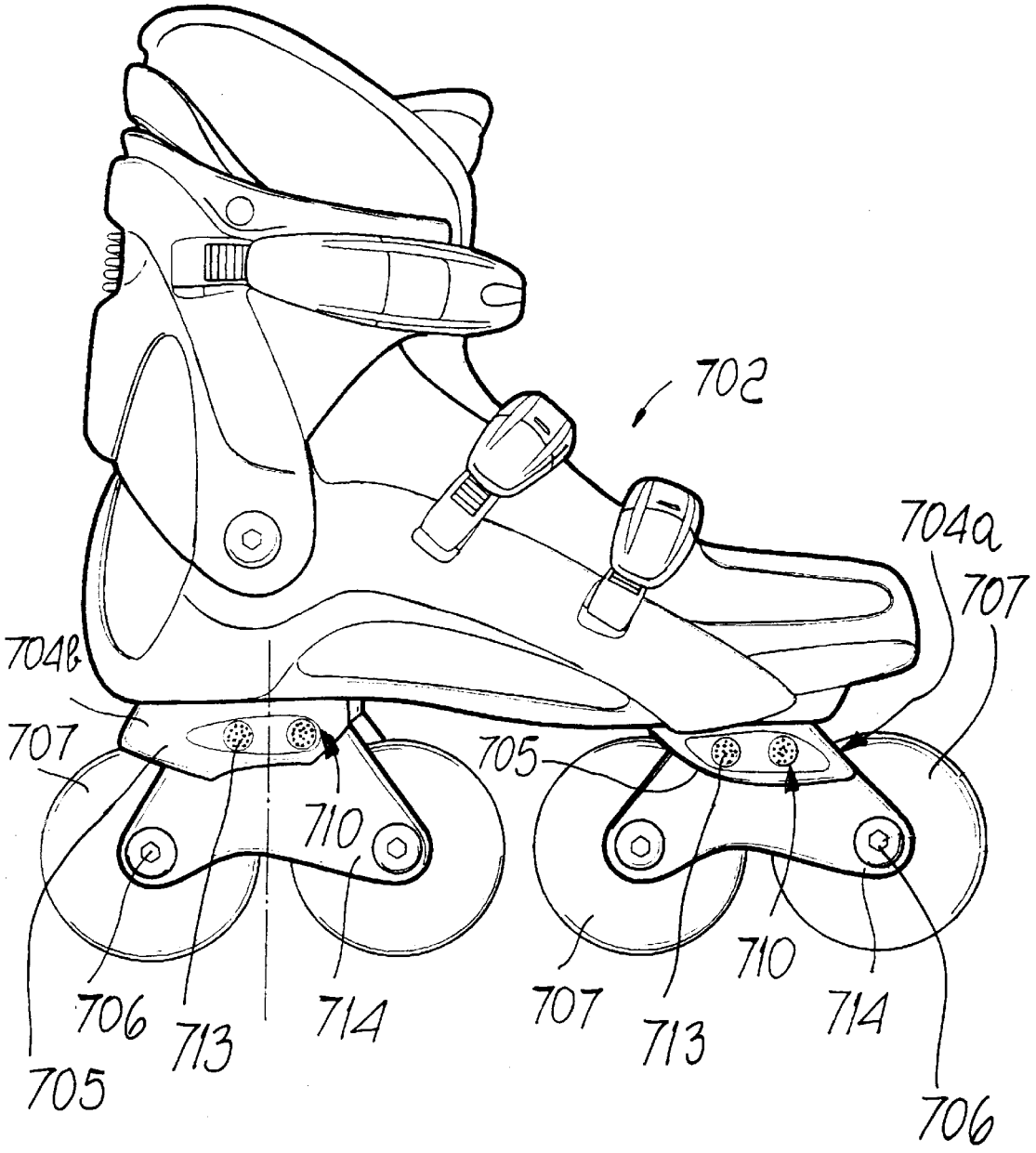

FIG. 14 illustrates an embodiment in which the frame is composed of a first frame half 704*a* and of a second frame half 704*b*; two lateral shoulders 705 protrude from the base of each one of said frame halves, said base supporting a shoe 702; the facing surfaces of said lateral shoulders 705, like the embodiments shown in FIGS. 8 or 9, are connected by means of second elements 710 to pairs of wings 714 between which the wheels 707 are pivoted by means of pivots 706.

In this case too, the second elements 710 have suitable bridges 713 which affect the thickness of the wings and the lateral shoulders to improve grip with the first elements the constitute said shoulders and the wings.

The embodiments of FIGS. 6 to 14 all have second elements which cushion the stresses edgeways. In this manner the active cross-section of the second elements is the maximum cross-section (width and length), thus allowing to considerably reduce the bulk of said second elements, particularly limiting their thickness.

Figure 15:
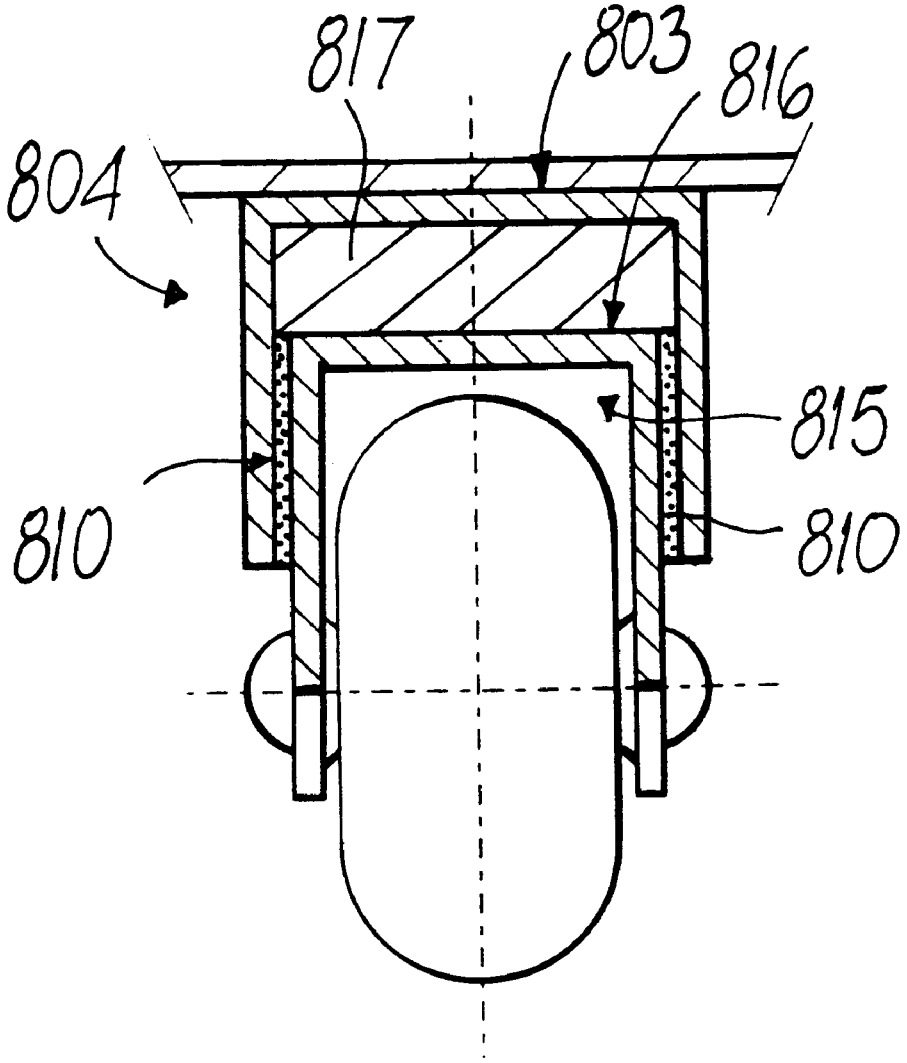
FIG. 15 is a view, similar to FIG. 3, of another embodiment.

FIG. 15 illustrates an embodiment which, with respect to what is shown in FIG. 9, has, between the horizontal portion 816 of the truck 815 and the base 803 of the frame 804, a third element 817 made of soft material, which cooperates with the second elements 810 in cushioning the stresses caused by uneven regions of the ground and the associated vibrations.

The third element 817 can also be similar to the second elements 810, optionally with a greater thickness since it must work by compression.

Figure 16:
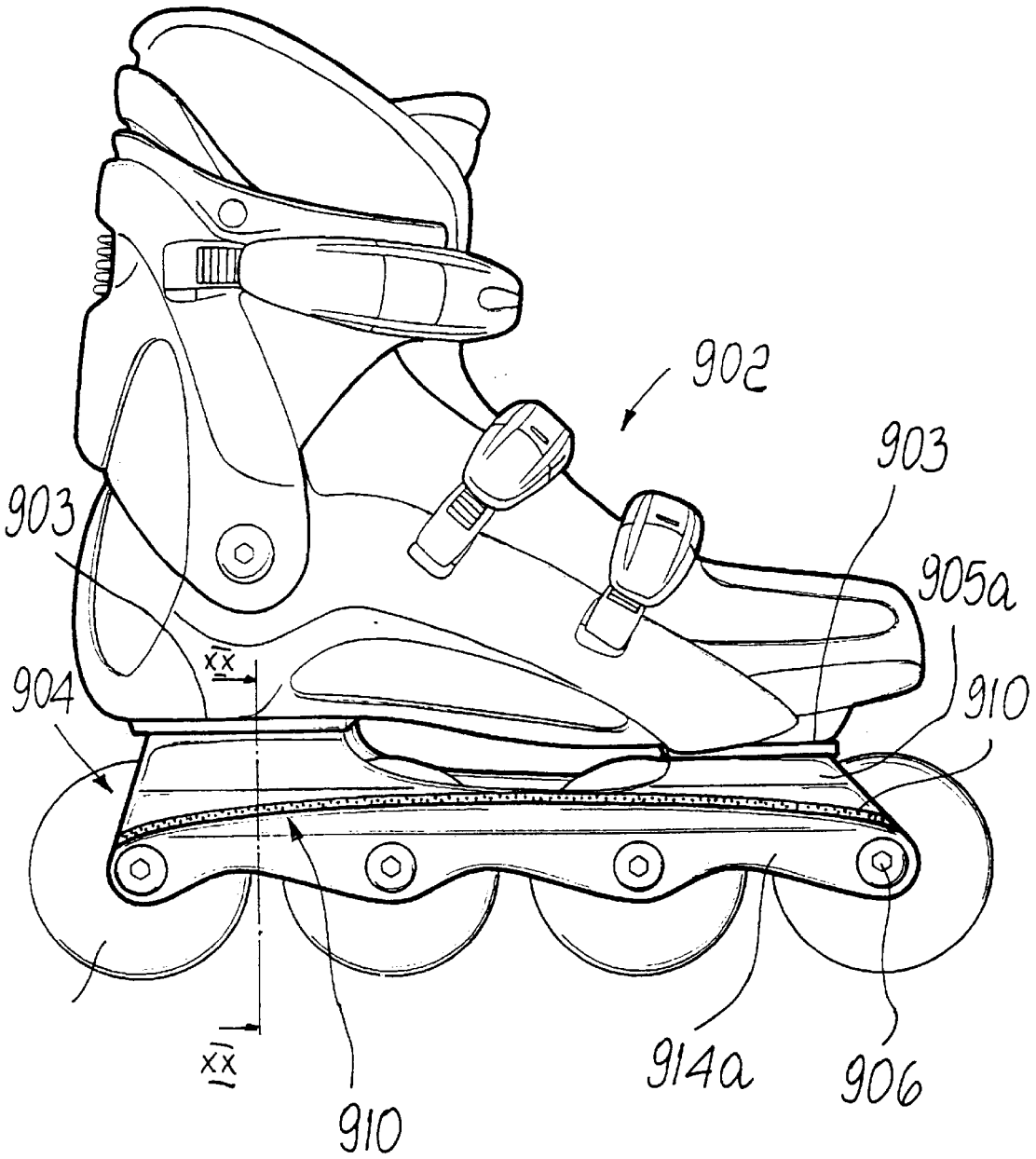
FIGS. 16, 17, 18 and 19 are views, similar to FIG. 1, of further embodiments.
Figure 17:
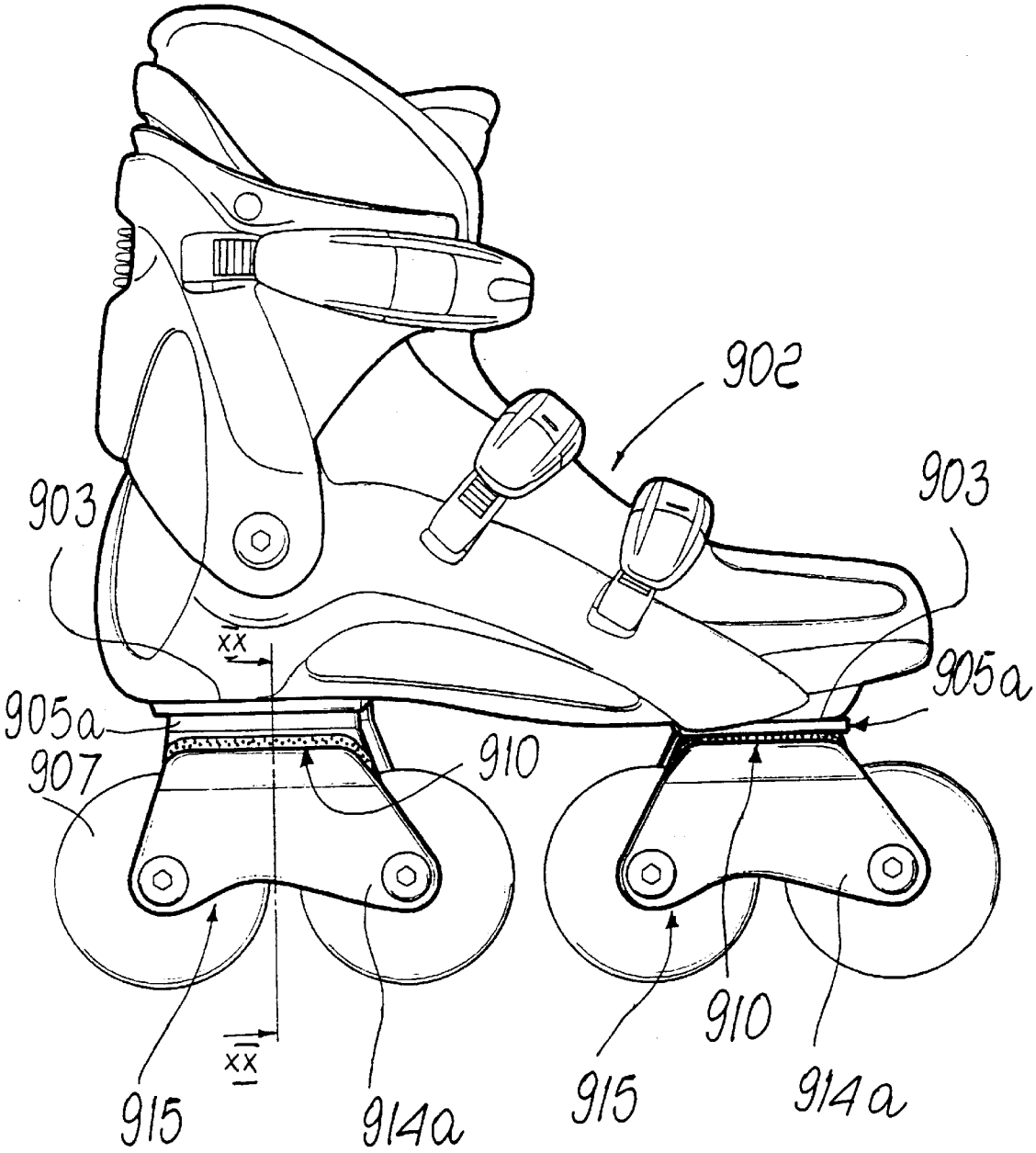
Figure 20:
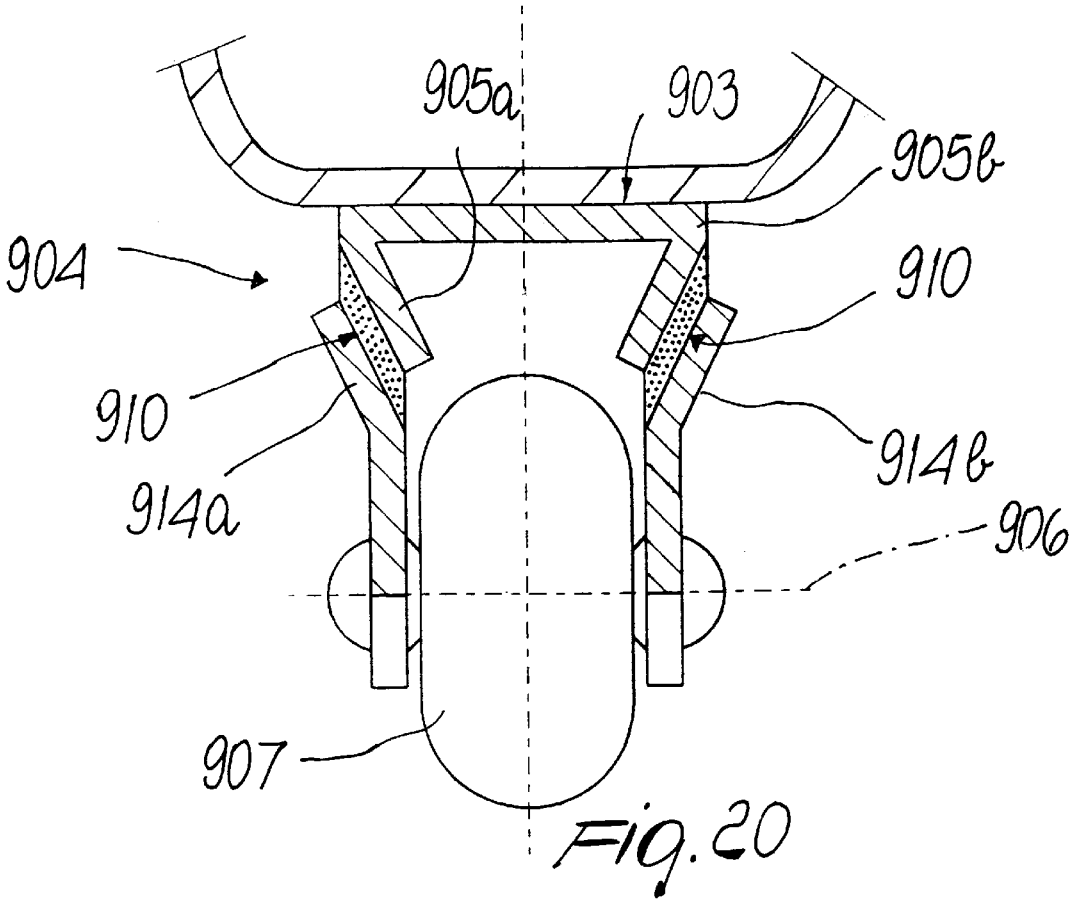
FIG. 20 is a sectional view, taken along the plane XX—XX of FIG. 16 or FIG. 17.

FIGS. 16, 17 and 20 illustrate further embodiments in which, in relation to the structural solutions of FIGS. 13 and 14, the second elements 910 are interposed between the lateral shoulders 905*a* and 905*b* of the frame 904 and the wings 914*a* and 914*b*, between which the wheels 907 are transversely rotatably pivoted by means of suitable pivots 906.

In the embodiment of FIG. 17, as shown in FIG. 7, said wheels 907 are articulated at suitable and separate trucks 915.

The particularity of the embodiments of FIGS. 16, 17 and 20 is the fact that the ends of said wings and lateral shoulders connected to the second elements are inclined with respect to the axis which is perpendicular to the base or bases 903 for supporting the shoe 902, as shown in FIG. 20. This particular arrangement allows the frame 904 to cooperate in cushioning stresses and in turn to apply a stress to the second elements 910 which is a mix of shear and compressive stress and is not merely unidirectional and compressive, as in the case of the prior art.

The predominant shear stress of the second elements 910 cushions the stresses that arrive from the wheels, while compressive stress, in addition to cooperating in the cushioning action, ensures a stronger stable coupling between the first and second elements.

Figure 18:
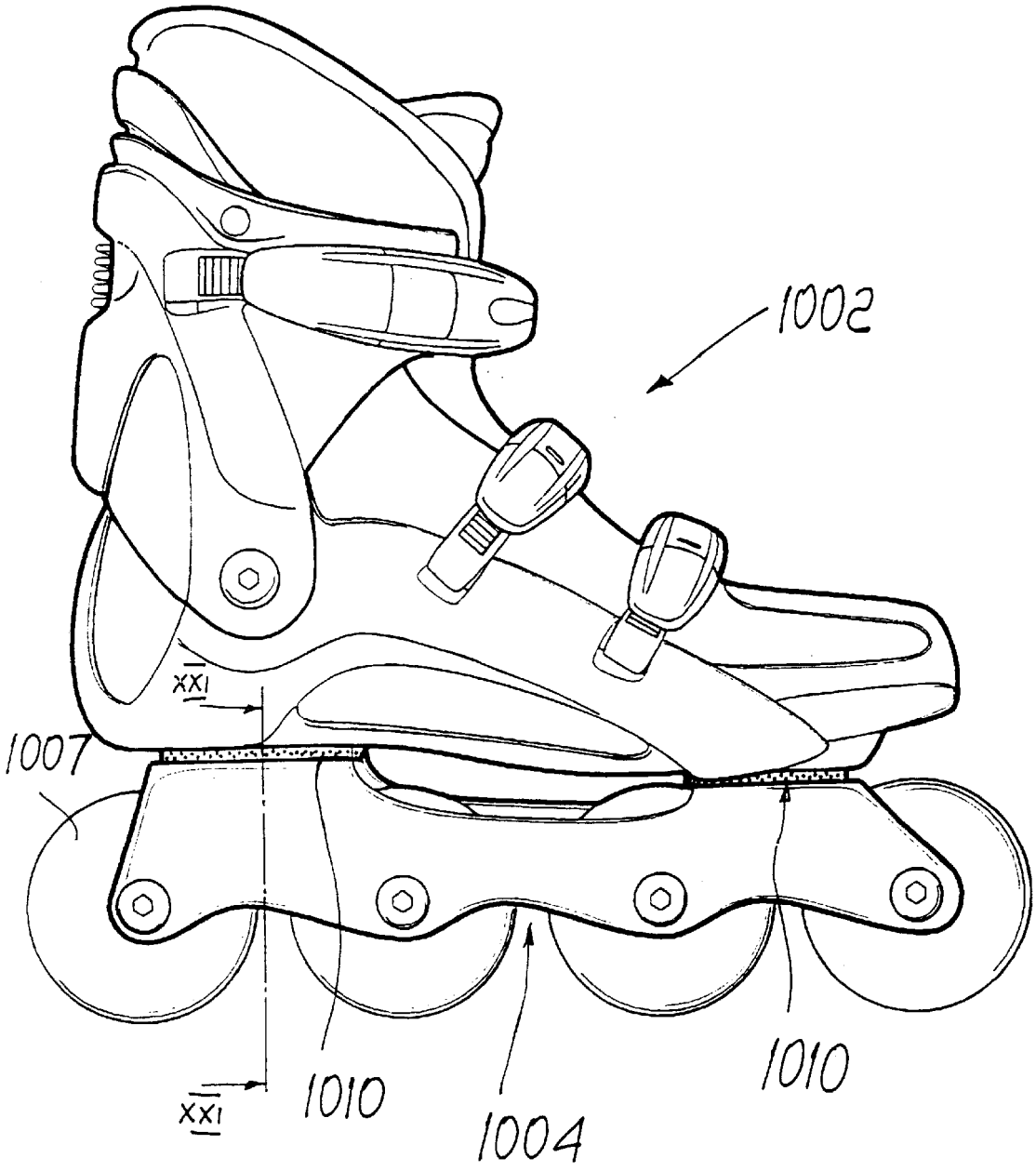
Figure 19:
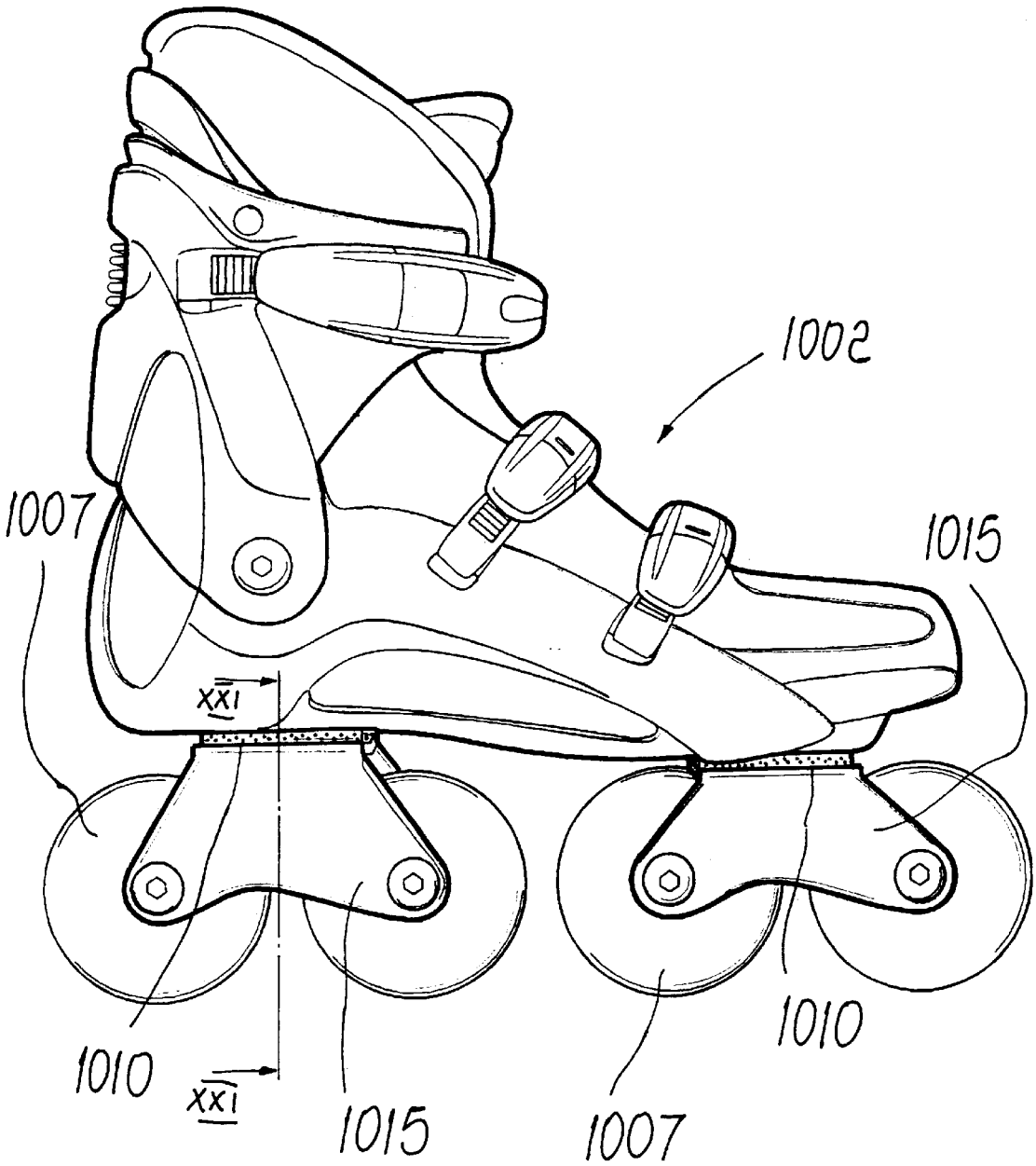
Figure 21:
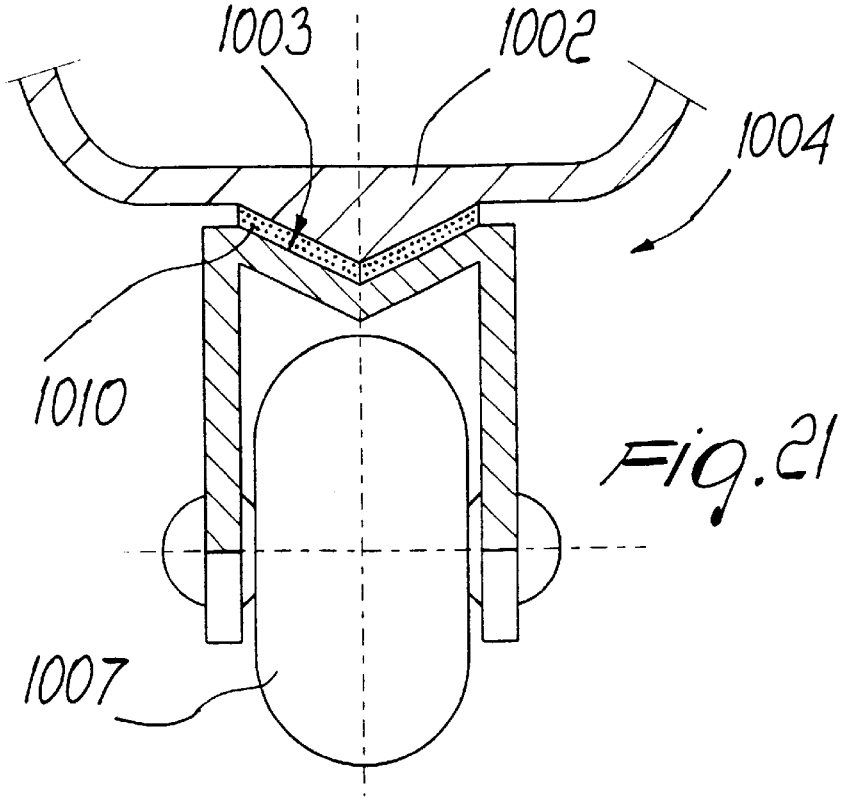
FIG. 21 is a sectional view, taken along the plane XXI—XXI of FIG. 18 or FIG. 19.

FIGS. 18, 19 and 21 illustrate another embodiment which, with respect to FIGS. 16, 17 and 20, differs in that the frame 1004, optionally constituted by trucks 1015, has one or more bases 1003 which are essentially V-shaped in transverse cross-section, with the vertex directed towards the wheel 1007. At least one second likewise-shaped element 1010 is interposed between said base and the complementarily shaped lower surface of the overlying shoe 1002.

The vertex of the V-shape can of course be directed towards the shoe and maintain the same functionality.

Figure 22:
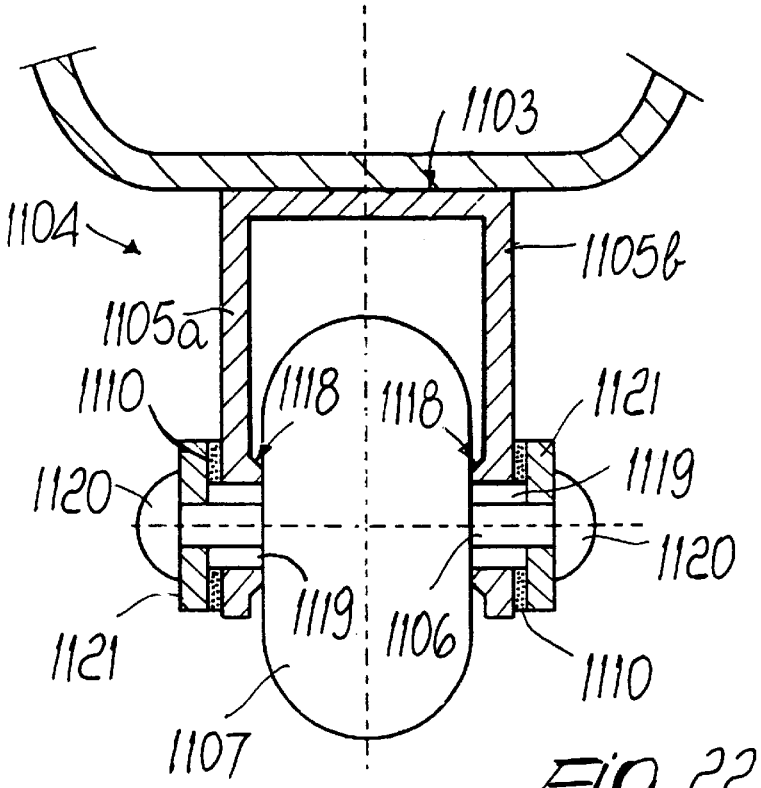
FIGS. 22, 23, 24 and 25 are sectional views, similar to FIG. 3, of further embodiments.
Figure 23:
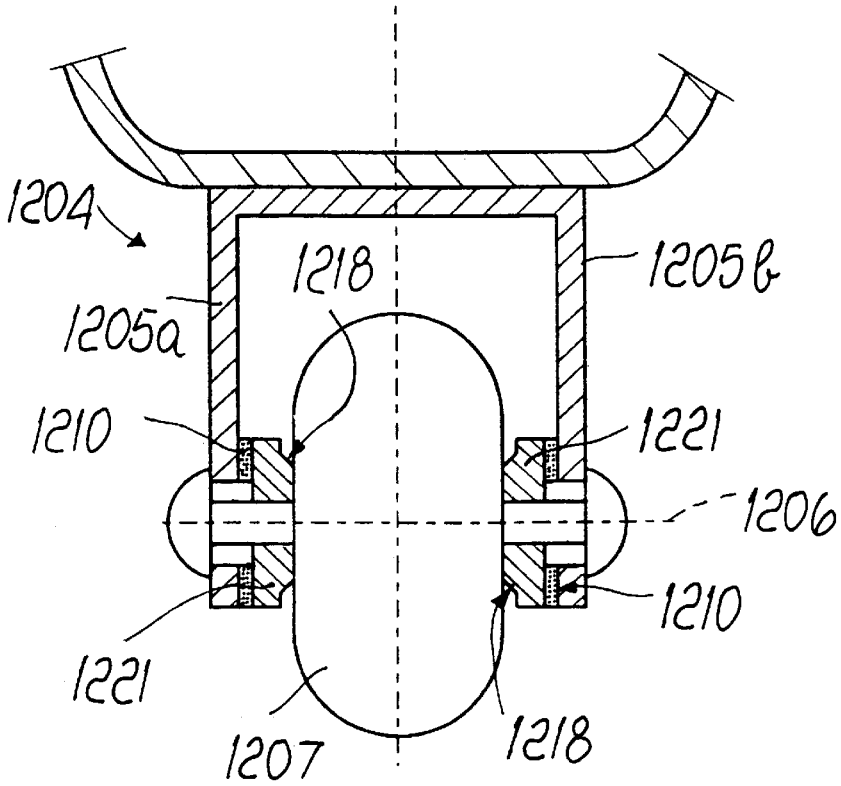

FIGS. 22 and 23 illustrate another embodiment, in which the frame 1104 again has at least one base 1103 from which two lateral shoulders 1105*a* and 1105*b* protrude. The shoulders have the characteristics of the first elements.

Proximate to the ends, said lateral shoulders are transversely perforated so as to allow to position pivots 1106 for the rotation of the wheels 1107.

Preferably at the facing surfaces, the lateral shoulders 1105*a* and 1105*b* have, at the holes for the pivots, an annular ridge 1118 which is arranged at the bearings for the rotation of said wheels.

Advantageously, pivots 1106 lie at suitable slots 1119 whose axis is preferably perpendicular to the ground.

A plate 1121 is arranged coaxially to the pivots 1106, adjacent to each head 1120 of each pivot. The plate is advantageously disk-shaped and made of the material that constitutes the first elements. Each of said plates is connected to the facing surface of the lateral shoulders 1105*a* and 1105*b* by means of a layer of second elements 1110.

As an alternative to the embodiment of FIG. 22, in FIG. 23 the inner facing lateral surfaces of the lateral shoulders 1205*a* and 1205*b* of the frame 1204 are connected, proximate to their ends for the pivoting of the pivots 1206, by means of a layer of second elements 1210, to plates 1221 which preferably have, towards the wheel 1207, an annular ridge 1218 adapted to rest at the bearings of said wheel.

Figure 24:
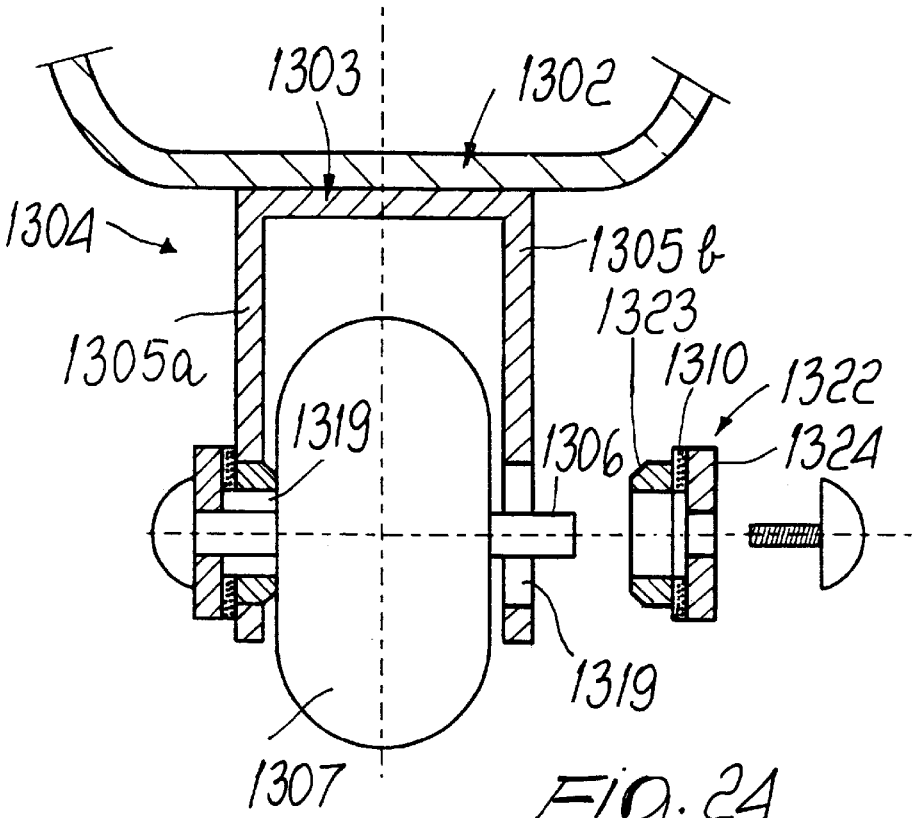
Figure 25:
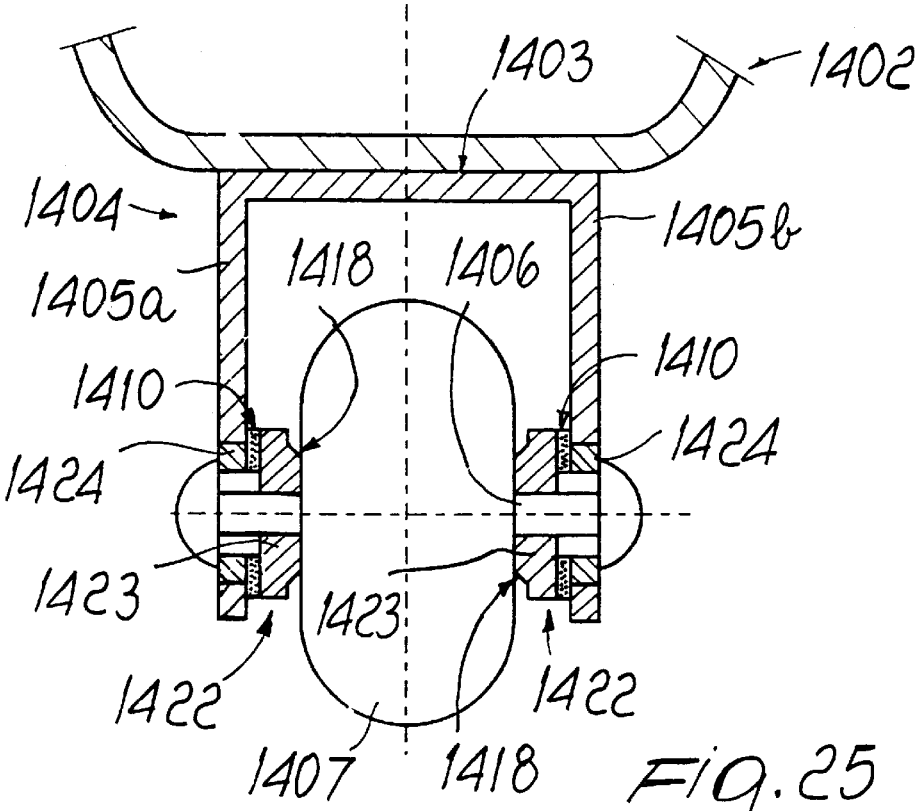

FIGS. 24 and 25 illustrate further embodiments of a frame 1304, which is again constituted by one or more bases 1303 for supporting a shoe 1302 from which two lateral shoulders 1305*a* and 1305*b* protrude; slots 1319 are provided proximate to the ends of said shoulders for the passage of pivots 1306 for the rotation of wheels 1307.

An insert 1322 can be inserted in said slots 1319 and is constituted by a first body 1323 which is shaped complementarily and can be inserted at said slot 1319; said first body is in turn provided with slots so as to allow said pivot 1306 to perform a vertical movement.

The insert 1322 is constituted by a second body 1324, which is substantially constituted by a disk-like element having the same axis as said first body. The two bodies are interconnected by a second element 1310 which has a slotted shape like said first body.

Advantageously, said pair of lateral shoulders, said first body and said second body are provided structurally like said first elements.

The embodiment shown in FIG. 25 illustrates a frame 1404 which is again constituted by one or more bases 1403 for supporting a shoe 1402, from which two lateral shoulders 1405*a* and 1405*b* protrude. Slots for the passage of suitable pivots 1406 for the rotation of wheels 1407 are formed proximate to the ends of said shoulders.

An insert 1422 can be inserted in the slots and, differently from the previous embodiment, must be inserted from the inside of the lateral shoulders after removing the wheel.

For this purpose, each of said inserts is constituted by a first body 1423 having an annular ridge 1418 adapted to rest at the bearings of the wheel.

Said first body has an axial hole for said pivot.

The insert 1422 is constituted by a second body 1424 which is substantially constituted by a disk-like element which is axially provided with a slotted shape which allows the vertical sliding of said pivots.

The first body and the second body are interconnected by a second element 1410 having a slotted shape like said second body.

In this embodiment it is possible to differentiate the manner of cushioning impacts, stresses or vibrations simply by replacing the second element 1410.

The materials and the dimensions that constitute the individual components of the invention may of course also be the most pertinent according to specific requirements.

What is claimed is:

1. A wheel supporting frame for skates, comprising:

rigid lateral shoulders for rotatably connecting a plurality of wheels between said shoulders;

a rigid base element for connection to a skate shoe; and a separate interconnecting element interconnected between said base element and each one of said lateral shoulders;

said interconnecting element being made of a single material which is different than the rigid material of said base element and said lateral shoulders and which is adapted to cushion at least one of stresses and vibrations and impacts transmitted between said lateral shoulders and said base element by said wheels; and said lateral shoulders being connected to said base element exclusively by means of said interconnecting element in a fixed and stable manner thereby to form a monolithic frame as a single continuous element.

2. A frame according to claim 1, wherein said interconnecting element comprises a plurality of longitudinal portions and a plurality of perpendicular portions which are perpendicular to said longitudinal portions, said perpendicular portions being staggered along the extension of said longitudinal portions.

3. A frame according to claim 1, wherein said interconnecting element is embedded between a double cladding formed by said base element and said lateral shoulders.

4. A frame according to claim 1, wherein said lateral shoulders are embedded in a double cladding interconnected by a plurality of bridges forming said interconnecting element.

5. A frame according to claim 1, wherein said base element has a horizontal base from which two depending shoulders downwardly protrude, said interconnecting element comprising a pair of interconnecting element layers associated at opposite surfaces of said vertical shoulders, said rigid lateral shoulders forming a pair of wings which protrude beyond lower ends of said depending shoulders and between which said wheels are transversely pivotally connectable by means of pivots, said pair of interconnecting element layers mutually interconnecting said pair of wings to said depending shoulders.

6. A frame according to claim 5, wherein said depending shoulders and said wings have through holes extending through thicknesses thereof, said interconnecting element further comprising bridges which are connected to said interconnecting element layers and which extend through said through holes of said depending shoulders and said wings.

7. A frame according to claim 5, wherein said lower ends of said depending shoulders and portions of said wings connected by said interconnecting element are inclined with respect to an axis that is perpendicular to said horizontal base.

8. A frame according to claim 1, wherein said base element has a horizontal base from which two depending shoulders downwardly protrude, and said rigid lateral shoulders are formed by wings of at least one truck, said truck having a horizontal portion for connecting said wings, said horizontal portion being arranged approximately parallel to said horizontal base of said base element, said wheels being freely pivotally connectable by means of pivots, proximate to free ends of said wings, and said interconnecting element comprising a pair of interconnecting element layers mutually interconnecting said wings to said depending shoulders.

9. A frame according to claim 8, comprising two separate trucks arranged between said depending shoulders.

10. A frame according to claim 8, wherein said depending shoulders and said wings have transverse slots extending through thicknesses thereof, said interconnecting element further comprising bridges which are connected to said interconnecting element layers and which extend through said transverse slots of said depending shoulders and said wings.

11. A frame according to claim 8, wherein said depending shoulders and said wings have longitudinal slots extending through thicknesses thereof, said interconnecting element further comprising bridges which are connected to said interconnecting element layers and which extend through said longitudinal slots of said depending shoulders and said wings.

12. A frame according to claim 8, configured as a half frame adapted to be connected below at least one of a front portion and a rear portion of a skate shoe.

13. A frame according to claim 12, further comprising an interposed element made of soft material arranged between said horizontal portion of said truck and said horizontal base of said base element and cooperates with said interconnecting element in cushioning stresses and vibrations.

14. A frame according to claim 13, wherein said third element is is made of the same material as said interconnecting element and is thicker than said interconnecting element.

* * * * *